United States Patent [19]

Marbot

[11] 4,077,309

[45] Mar. 7, 1978

[54] APPARATUS FOR CLOSING LINED BOXES

[75] Inventor: Jakob Marbot, Schaffhausen, Switzerland

[73] Assignee: S I G Scheizerische Industrie-Gesellschaft, Neuhausen am Rheinfall, Switzerland

[21] Appl. No.: 767,030

[22] Filed: Feb. 9, 1977

[30] Foreign Application Priority Data

Sep. 2, 1975 Switzerland ..... 11334/75

[51] Int. Cl.[2] ..... B65B 7/06

[52] U.S. Cl. ..... 93/27; 53/371; 93/36.01

[58] Field of Search ..... 53/371, 373; 93/36.01, 93/36.8, 8 R, 22–30

[56] References Cited

U.S. PATENT DOCUMENTS

| | | | |
|---|---|---|---|
| 2,415,978 | 2/1947 | Vergobbi | 53/373 |
| 3,380,222 | 4/1968 | Bergmann et al. | 93/36.01 X |
| 3,516,336 | 6/1970 | Maulini et al. | 93/36.01 |
| 3,583,294 | 6/1971 | Lense et al. | 93/36.01 |

*Primary Examiner*—James F. Coan

*Attorney, Agent, or Firm*—Spencer & Kaye

[57] ABSTRACT

An apparatus for closing an open end of a lined folded cardboard box has a conveyor on which the boxes are advanced serially and spaced from one another; a wide flap opener for outwardly bending the wide flaps of each box at the opening; a lining spreader disposed downstream of the wide flap opener and including a spreader finger; a first drive mechanism connected to the spreader finger for rotating the same and cyclically introducing it into the opening of the serially advanced cardboard boxes for spreading and partially flattening a leading end of the box lining; and a pressure shuttle carrying two pressure rails for movement downstream of the lining spreader. The pressure rails cooperate bilaterally with the lining precedingly handled by the lining spreader for completing the flattening of the lining. The apparatus further has a second drive mechanism for imparting a reciprocating motion to the pressure shuttle for effecting a reciprocating motion of the pressure rails. The motion of the spreader finger is coordinated with that of the pressure shuttle; and the motion of the conveyor is synchronized with those of the spreader finger and the pressure shuttle.

10 Claims, 15 Drawing Figures

APPARATUS FOR CLOSING LINED BOXES

BACKGROUND OF THE INVENTION

This invention relates to an apparatus for closing continuously and spacedly advanced cardboard boxes which are open at least at one end and which are provided with an inner lining glued to the box and projecting in the zone of the opening beyond the crease lines of the box flaps. The apparatus includes a wide flap opener for bending outwardly the wide flaps of the box.

Apparatuses of the above-outlined type find particular use in automatic packaging machines for preparing the cardboard boxes for the filling operation and to subsequently perform the lid (flap) closing operation. Thus, in known packaging machines the prefabricated cardboard boxes which are stacked in a flat condition, are introduced into a chain conveyor which advances the boxes through the individual operational stages and eventually forwards the filled and closed package to a machine outlet.

When boxes without inner lining or boxes with lining glued entirely to the cardboard are used, these operations may be performed in a continuous manner. In case of cardboard boxes which have a glued inner lining projecting beyond the flap creases and having non-glued ends, such a continuous operation, however, has not been possible heretofore. The preparation of the boxes for welding the ends of the thermoplastic inner lining had to be performed in a timed sequence for which complex devices with cam discs and control cams were required. Because of structural limitations, the output of these known apparatuses has been relatively small.

In view of the fact, however, that cardboard boxes having outwardly projecting inner linings are used with increasing frequency because of a better seal insured by such linings, the above-noted disadvantages has become important.

SUMMARY OF THE INVENTION

It is an object of the invention to provide an apparatus of the above-outlined type in which the stated disadvantages of the prior art are eliminated and which has a high output capacity.

This object and others to become apparent as the specification progresses, are accomplished by the invention, according to which, briefly stated, the apparatus for closing an open end of a lined folded cardboard box has a conveyor on which the boxes are advanced serially and spaced from one another; a wide flap opener for outwardly bending the wide flaps of each box at the opening; a lining spreader disposed downstream of the wide flap opener and including a spreader finger; a first drive mechanism connected to the spreader finger for rotating the same and cyclically introducing it into the opening of the serially advanced cardboard boxes for spreading and partially flattening a leading end of the box lining; and a pressure shuttle carrying two pressure rails for movement downstream of the lining spreader. The pressure rails cooperate bilaterally with the lining precedingly handled by the lining spreader for completing the flattening of the lining. The apparatus further has a second drive mechanism for imparting a reciprocating motion to the pressure shuttle for effecting a reciprocating motion of the pressure rails. The motion of the spreader finger is coordinated with that of the pressure shuttle; and the motion of the conveyor is synchronized with those of the spreader finger and the pressure shuttle.

Figure 7:
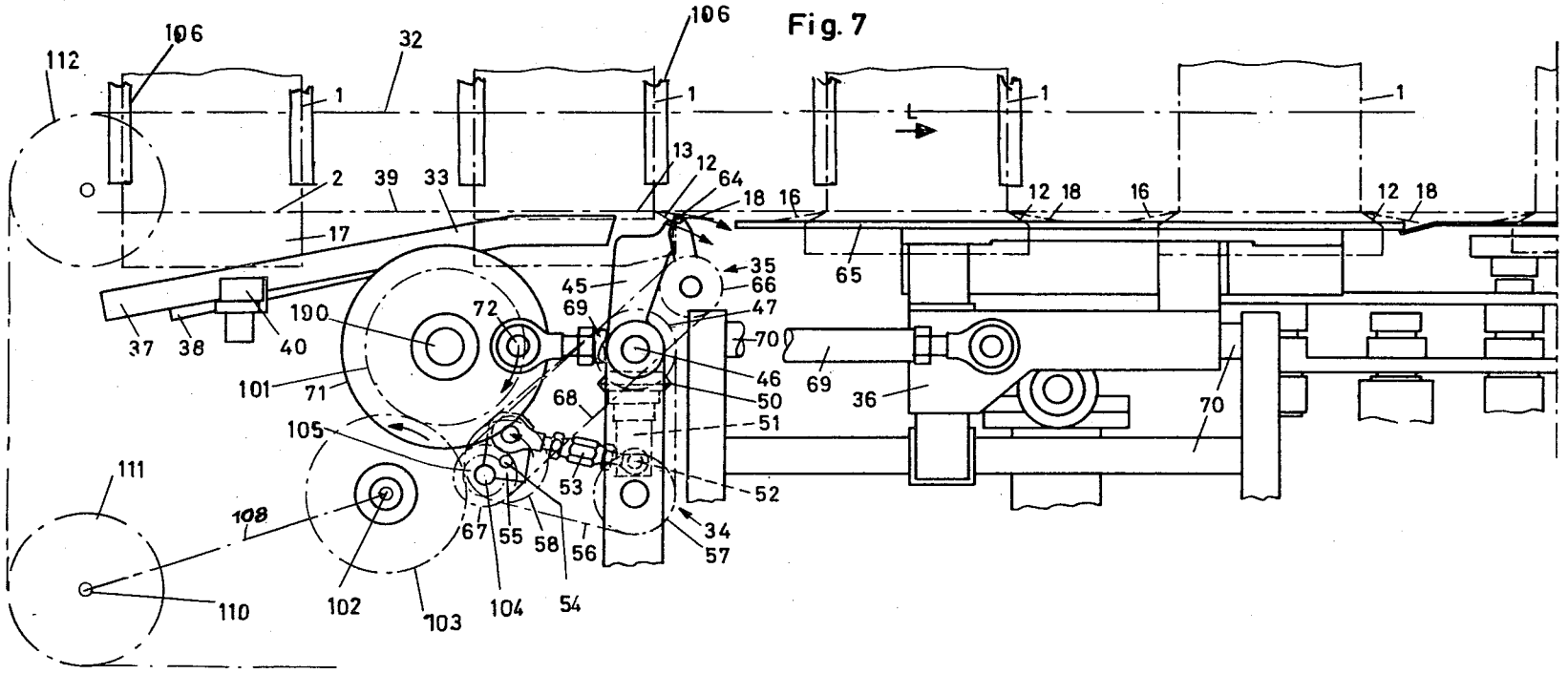
FIG. 7 is a partially schematic side-elevational view of a preferred embodiment.
Figure 7A:
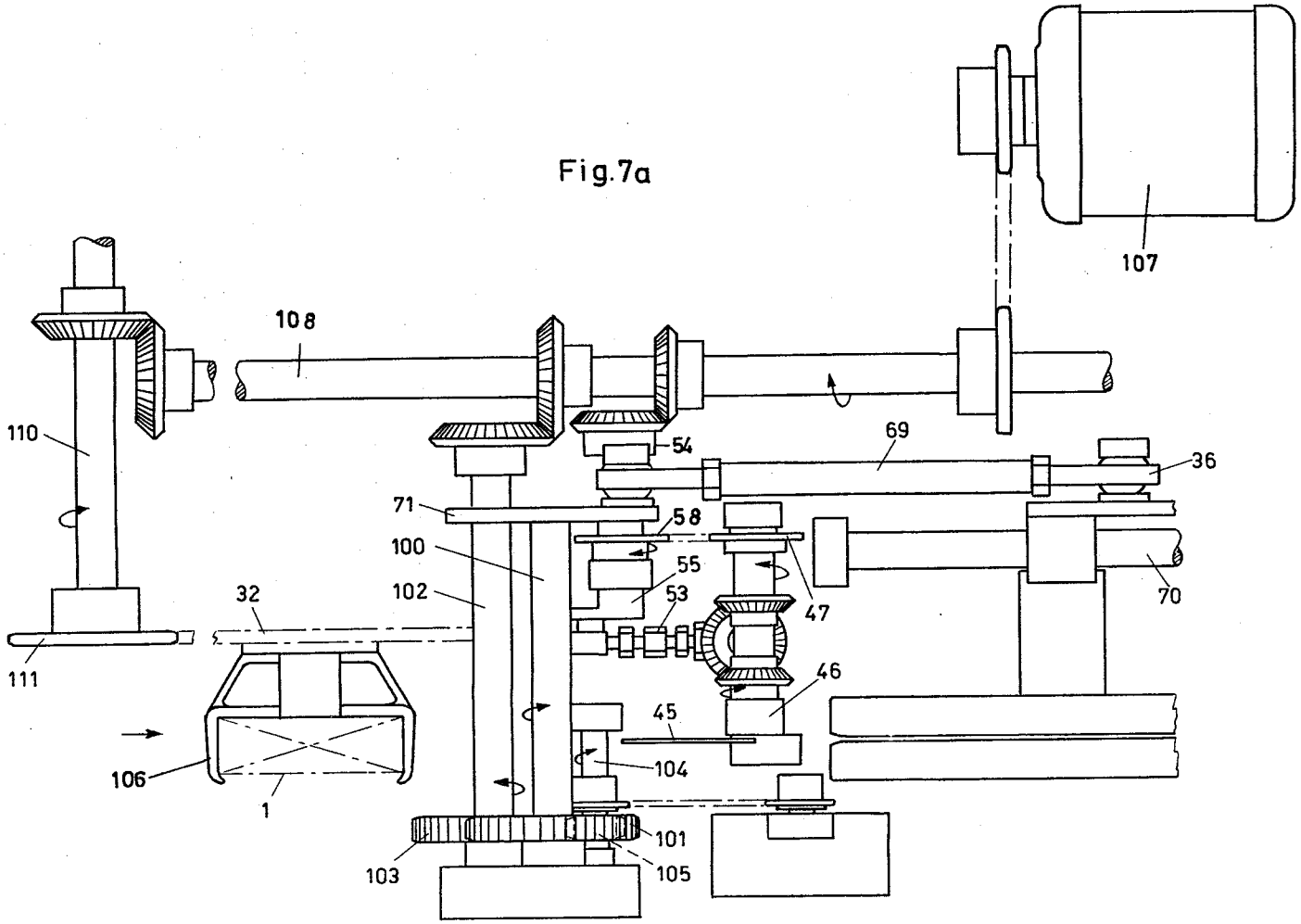

FIG. *7a* is a fragmentary top plan view of the structure illustrated in FIG. 7.

Figure 8:
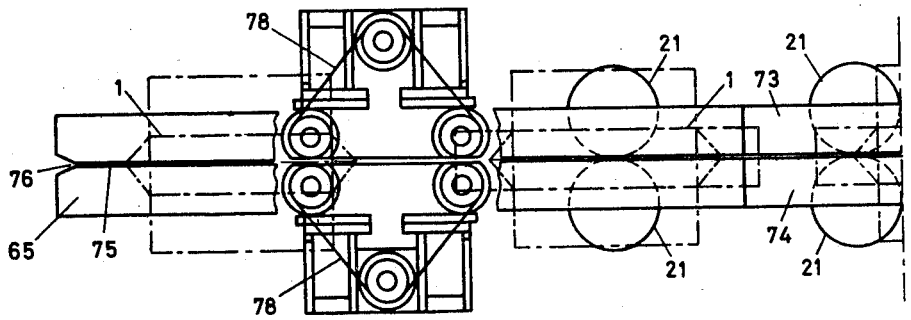

FIG. 8 is a fragmentary top plan view of the structure illustrated in FIG. 7.

Figure 9:
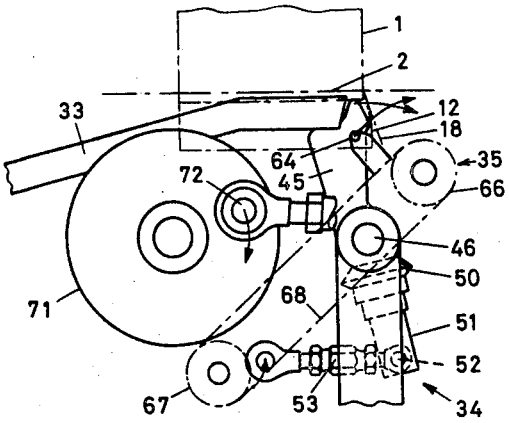

FIG. 9 is a side-elevational detail of FIG. 7 to illustrate the mode of operation of a lining spreader and small flap lifter at the beginning of the spreading operation.

Figure 10:
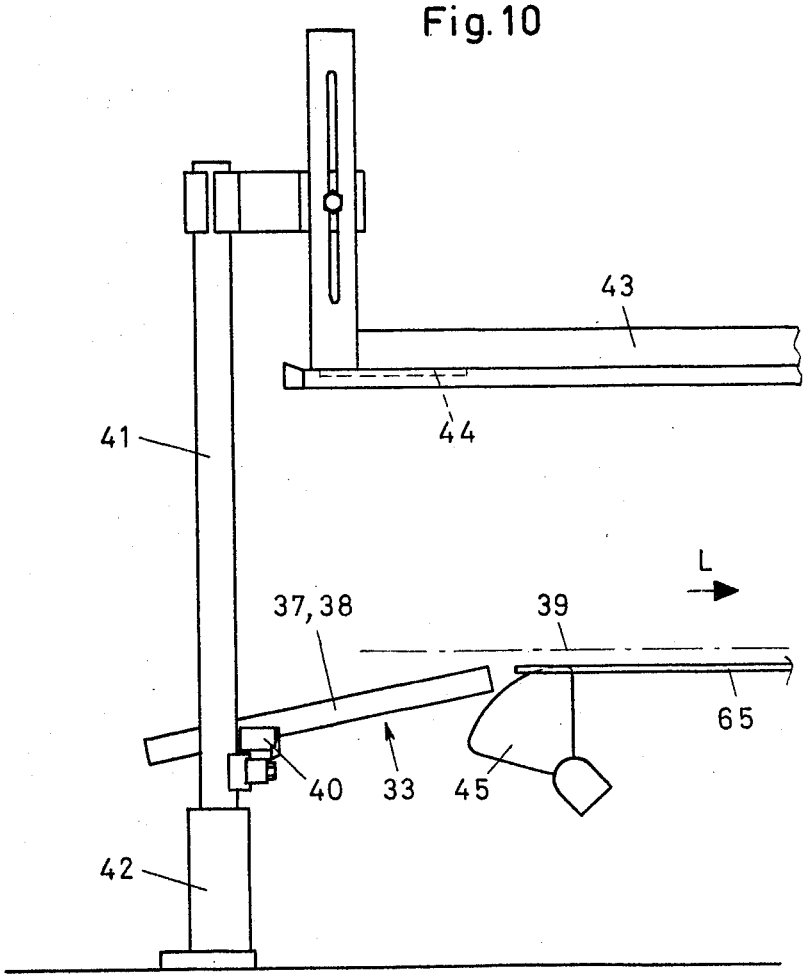

FIG. 10 is a schematic side-elevational view of the wide flap opener forming part of the preferred embodiment.

Figure 11:
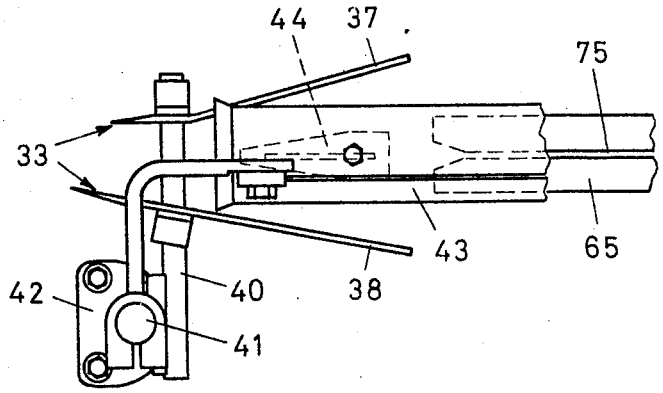

FIG. 11 is a top plan view of the structure illustrated in FIG. 10.

Figure 12:
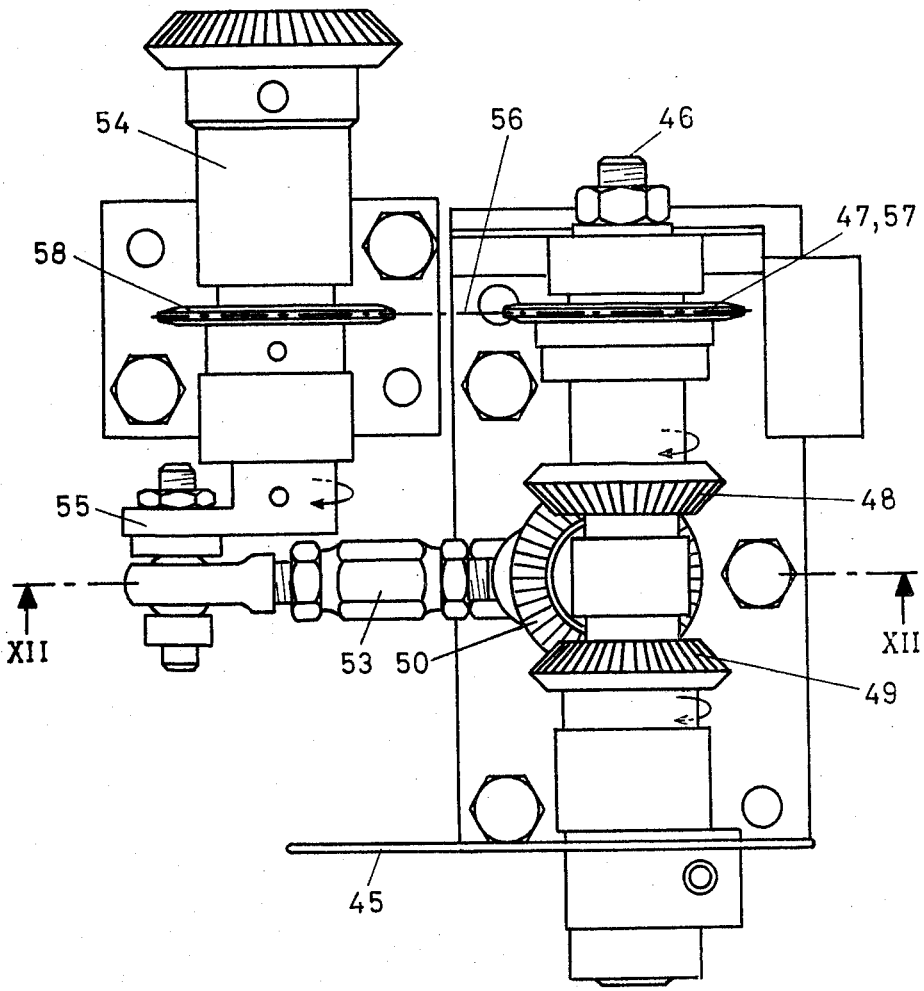

FIG. 12 is a top plan view of the lining spreader forming part of the preferred embodiment.

Figure 13:
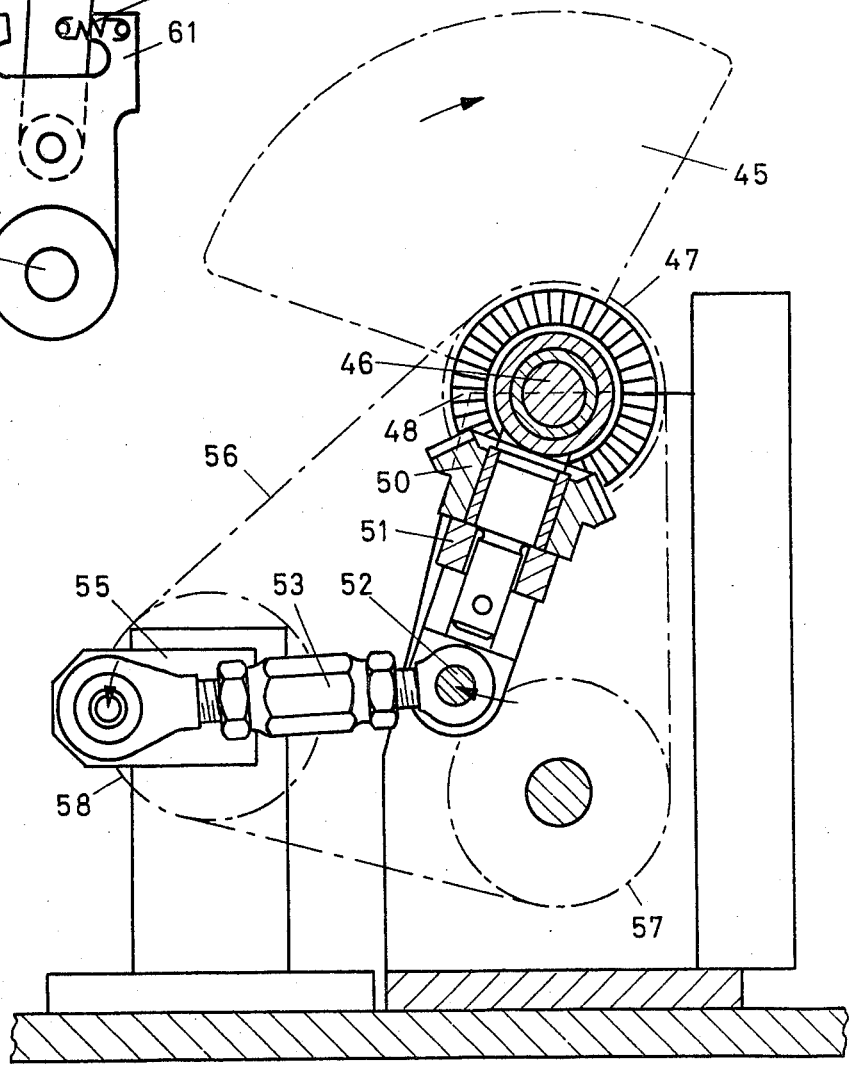

FIG. 13 is a sectional view taken along line XIII—XIII of FIG. 12.

Figure 14:
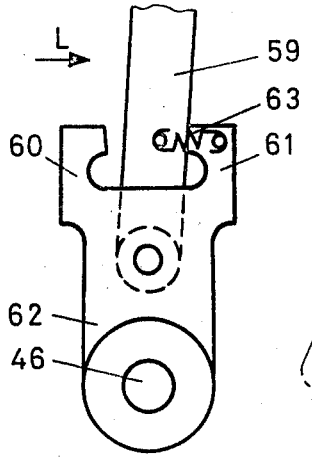

FIG. 14 is a fragmentary schematic side-elevational view of a modified detail of the preferred embodiment.

DESCRIPTION OF THE PREFERRED EMBODIMENT

Turning now to FIGS. 1–6, the individual operational stages for closing the bottom 2 of a prefabricated foldable cardboard box 1 will be discussed. As seen, for these operations the box has already been erected from its completely flat (storage) state. The floor 2 is bounded by crease lines 3, 4, 5, 6, whereas the lid 7 is bounded by crease lines 8, 9, 10 and 11. A weldable lining 12 made, for example, of thermoplastic material or paper coated with a weldable material, is glued up to but not beyond the crease lines 3–6 and 8–11. Thus, the ends of the lining 12 which have a rectangular cross section and which project at the openings 13 and 14 are not glued to the box.

Figure 1:
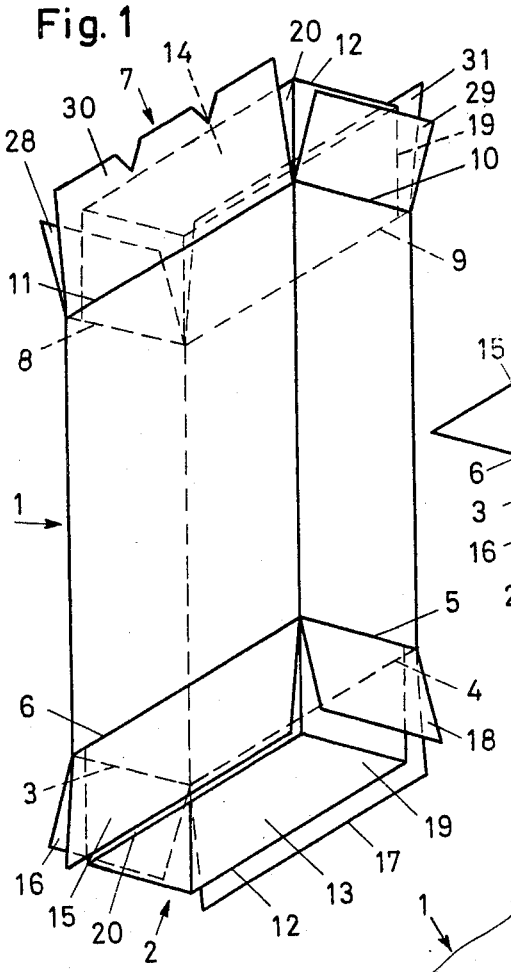
FIGS. 1 through 6 are schematic perspective views of a box, or a portion thereof, having a glued-in lining, to illustrate sequential operational stages for folding the box bottom.
Figure 2:
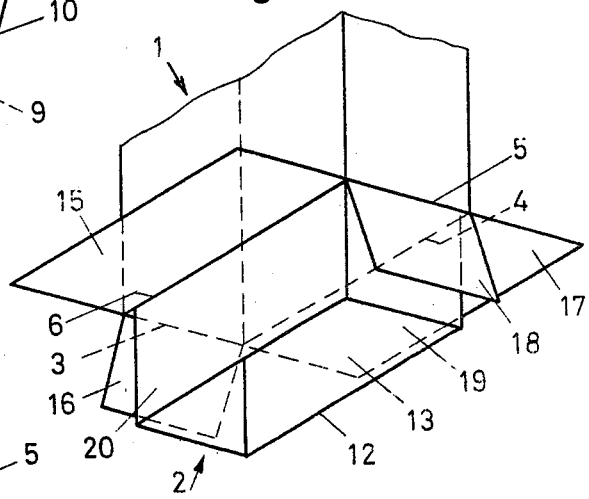
Figure 3:
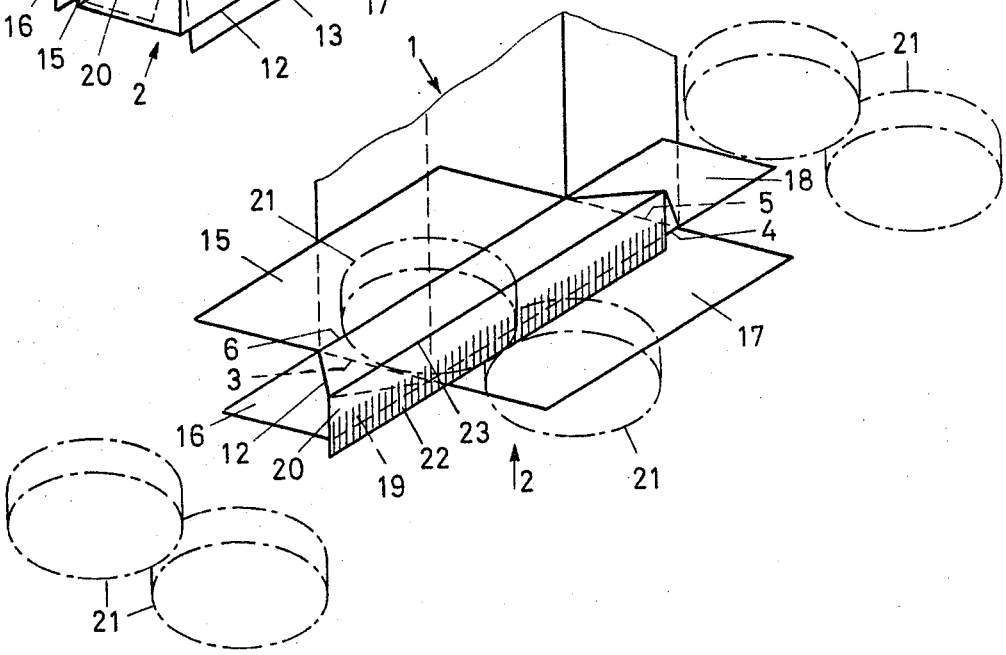
Figure 4:
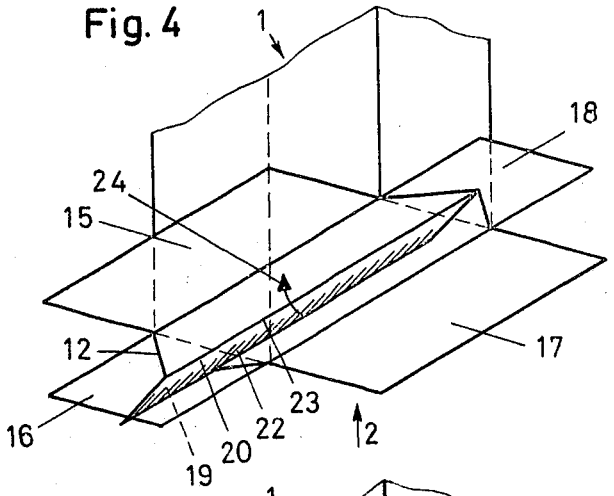

Turning now particularly to FIG. 2, in the first stage of operation shown therein, the lower wide flaps 15 and 17 are, along their crease lines 4 and 6 bent outwardly into an approximately horizontal position and subsequently the lower narrow flaps 16 and 18 are bent outwardly in a similar manner along the respective crease lines 3 and 5. The lower terminus of the lining 12 thus projects at the floor opening 13 freely from the box flaps 15–18 and can be tightly closed by applying a welded seam thereto. For this purpose, oppositely located wall strip portions 19 and 20 of the projecting lining end are pressed together flat and are welded to one another by means of conventional welding shoes or oppositely rotating heated rollers 21 indicated with dash-dot lines in FIG. 3. The welded seam 22 is thereafter folded in the direction of the arrow 24, as indicated in FIG. 4, along the seam line 23 which extends parallel to the crease lines 4 and 6 of the box. Further, the weld 22 is placed into the plane of the box floor 2.

Figure 5:
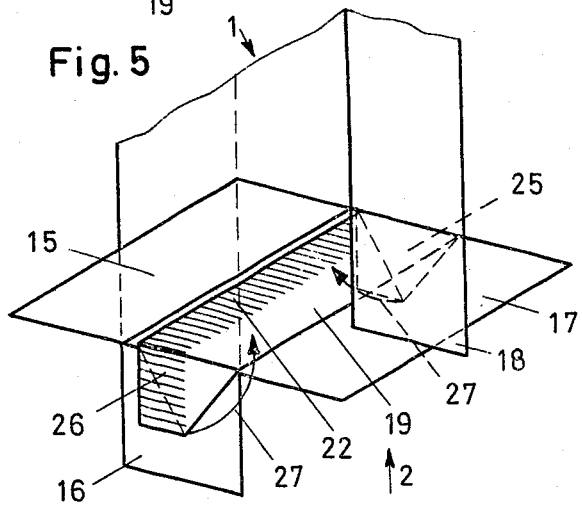
Figure 6:
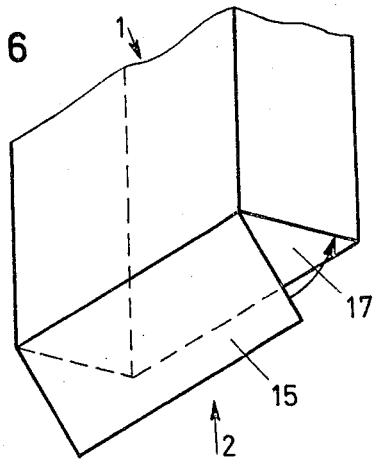

Subsequently, the lower narrow flaps 16 and 18 are, together with the remaining corners 25 and 26 of the lining 12 folded inwardly along the crease lines 3 and 5 in the direction of the arrows 27 as shown in FIG. 5. To complete this operation, one wide flap 17 is also folded inwardly, and is provided with an adhesive onto which the other wide flap 15 is then pressed.

After filling the boxes with the goods and subsequent to later monitoring operations, the lid flaps 28, 29, 30 and 31 are folded outwardly, the upper lining end is welded and the lid folding is performed in a manner analogous to the operations described above in connection with the bottom flaps and are therefore not discussed here in detail.

The apparatus for closing the bottom of the lined cardboard boxes will now be described with reference to FIGS. 7, *7a* and 8–14; particularly the preparatory steps for welding the lining will be set forth. The apparatus which may be a component of a packaging machine that includes a chain conveyor, has a plow-shaped wide flap opener 33, a lining spreader 34, a narrow flap lifter 35 and a reciprocating pressure shuttle 36.

The boxes 1 are fed continuously in the feed direction L in a spaced relationship by a chain conveyor 32 which is trained about a plurality of sprockets, such as indicated at 111 and 112. The chain conveyor 32 includes clamp members 106 which are attached at predetermined distances to the conveyor 32 and which engage and carry the boxes 1 as shown in FIGS. 7 and *7a*. The chain conveyor 32 is driven by a motor 107 via a main drive shaft 108 connected to a shaft 110 of the sprocket 111 by means of meshing bevel gears. Thus transported by the chain conveyor 32, the boxes 1 first arrive, in sequence, in an open condition in the zone of the wide flap opener 33 with their bottom portion 2. The wide flap opener comprises two legs 37 and 38 which converge in the direction of the approaching boxes 1, and are directed obliquely downwardly in such a manner that the two lower wide flaps 15 and 17 of the box 1 are engaged by the leg tips, then bent outwardly about their crease lines 4 and 6 and then positioned in the plane 39 of the box bottom 2 to protrude from the box like wings.

The two legs 37 and 38 of the wide flap opener 33 are adjustably secured in a carrier arm 40 which, in turn, is connected to a carrier column 41 anchored in a support 42. To the carrier column 41 there is further secured a height-adjustable box hold-down device 43 which is arranged parallel to and spaced from the plane 39 of the box bottom. The hold-down device 43 surrounds a guide 44 for the upper wide flaps 29, 31 of the box 1.

Upon further advance of the box 1, the latter arrives in the zone of a lining spreader 34 disposed downstream of the wide flap opener 33. The lining spreader 34 has a rotating spreader finger 45 or spreader lug which penetrates into the bottom opening 13 of the lower end of the lining 12 in order to spread the same and simultaneously slightly lift the leading lower narrow flap 18 of the box 1. The start of the spreading operation may be observed in FIG. 9 while in FIG. 7 the spreader finger 45 has already partially spread the lining 12 and the narrow flap lifter 35 has further lifted the leading narrow flap 18 in a manner to be described later. During the penetration of the spreader finger 45 its circumferential speed has to be greater than the constant advancing speed of the box 1 to insure that the relative path traveled in this interval by the spreader finger 45 with respect to the box 1 effects the spreading of the lining 12. During the spreading there is effected already a partial flat positioning of the forward (leading) end of the lining 12 by bringing together the wall strips 19 and 20.

To provide for the above-discussed motional relationships, it has been found expedient to cause the spreader finger 45 to rotate about a support shaft 46 in a "pulsating" manner. For this purpose a differential gear is provided which comprises a bevel drive gear 48 rotationally fixedly secured to a sprocket wheel 47 and a driven bevel gear 49 rotationally fixedly secured to the spreader finger 45. In this connection particular reference is made to FIGS. 7, 9, 12 and 13. Both bevel gears 48 and 49 are freely rotatably supported on the support shaft 46. The transmission of torque from the bevel drive gear 48 to the driven bevel 49 is effected by means of a pivotal pinion gear 50 which is freely rotatably supported on a pivotal arm 51 arranged perpendicularly to the support shaft 46. The pivotal arm 51 is supported on the shaft 46 for a limited, cyclical pivotal motion and its free end is articulated at 52 to the terminus of a pull rod 53 which, in turn, is reciprocated by a crank 55 provided with a crank pin and arranged on the drive shaft 54. As a result of this arrangement, the pivotal arm 51 executes, with the pivotal pinion gear 50, cyclical pivotal motions about the support shaft 46, whereby the uniform rotational motion of the bevel drive gear 48 is transformed into a non-uniform rotation of the driven bevel gear 49 and the spreader finger 45.

The drive of the bevel drive gear 48 is effected by the sprocket 47, the chain 56 of which (illustrated in dash-dot lines) is deflected by a further sprocket 57 and is driven by a drive sprocket 58 affixed to the drive shaft 54. The drive shaft 54, in turn, is coupled to the main drive shaft 108 by meshing bevel gears. The uniform rotational movement and the pivotal motion superimposed thereon are synchronized with the travel of the boxes 1 in such a manner that the circumferential speed of the spreader finger 45 during its penetration into the lower opening 13 of the box 1 is approximately equal to the travelling speed of the box and then the circumferential speed is increased for the spreading operation proper. Further, subsequent to the spreading of the lining and the partial lifting of the narrow flap 18, the circumferential speed is again reduced. Such speed reduction takes place after the spreader finger 45 has moved away from the zone of the opening 13.

In accordance with another embodiment of the spreader 34, there is insured a soft penetration of the spreader finger 59 (FIG. 14) into the lining 12 by means of a resilient support of the spreader finger 59. The latter is disposed between two tines 60, 61 of a forked arm 62 and is urged in the travelling direction L against the leading tine 61 by means of a tension spring 63. In case resistance is met, the spreader finger 59 yields resiliently until it abuts the trailing tine 60. This embodiment of the spreader finger is particularly adapted for use in the case of linings made of paper or other less tear-resistant material.

The leading narrow flap 18 which is already partially raised by the spreader finger 45 is now entirely lifted by a folding pin 64 of the narrow flap lifter 35 up to the height of the base plate 65 secured to the pressure shuttle 36. The narrow flap lifter 35 is secured to a chain 68 (shown in dash-dot lines) which is trained about two sprockets 66 and 67. The sprocket 67 is driven by the main drive shaft 108 via shaft 102 (which is coupled to the main drive shaft 108 by meshing bevel gears), gear 103 (which is affixed to shaft 102), gear 105 (which meshes with gear 103) and shaft 104 (to which there are affixed gear 105 and sprocket 67). The circumferential speed with which the chain and the folding pin 64 travel is synchronized with the box feed speed and is higher than the greatest circumferential speed of the spreader finger 45. Consequently, subsequent to the partial lifting of the leading narrow flap 18 by the spreader finger 45, the faster folder pin 64 takes over the lifting operation from the spreader finger 45 to continue, on its own, to lift the narrow flap 18.

In the meantime, the carriage-like pressure shuttle 36 is pulled into a forward position by means of a pull rod 69 articulated thereto, to insure that the raised narrow flap can be pushed onto the surface 77 of the base plate 65. The drive of the pressure shuttle 36 which is guided by the guide rods 70 is effected by a crank wheel 71, which has an eccentric pin 72 to which the pull rod 69 is articulated. The crank wheel 71 is driven by the main drive shaft 108 via a gear 101 (meshing with the gear 103 which, in turn, is connected to the main drive shaft 108 as set forth above) and a shaft 100 (to which there are affixed the gear 101 and the crank wheel 71).

Subsequent to pushing the lower narrow flap 18 onto the base plate 65, upon further travel of the box, the other flaps too, will be positioned entirely on the base plate 65. The latter, as seen in FIG. 8, carries two parallel pressure rails 73 and 74 between which there is provided a slot 75 extending in the traveling direction L. The pressure rails 73, 74, driven by the pressure shuttle 36, reciprocate downstream of the lining spreader 34. The slot 75 widens at 76 at its frontal end to insure that the forward (leading) end of the lining 12 which is already partially flattened by the spreader finger, is readily introduced into the slot 75. As the projecting end of the lining 12 passes between the rails 73, 74, it is folded completely flat.

A compression of the projecting parallel lateral strips 19 and 20 of the lining 12 prior to welding is effected by two pressure belts 78 which are provided underneath the base plate 65 in a face-to-face arrangement and between which the projecting end of the lining 12 is guided.

Upon further travel of the box, the lining 12 is welded by stationarily supported heated rollers 21.

The pressure shuttle 36 which initially is moved in the direction of travel L, is again drawn into its starting position by its pull rod 69 and thus releases the box to permit performance of the successive operations for completing the bottom folding. These successive operations are performed in a known manner and therefore are not described in detail. Subsequently, the boxes may be charged with the goods and then the box can be closed at the top. For this operation an apparatus identical to that described in connection with the folding of the box bottom can be used in a suitably adapted manner.

The narrow flap opener described above and forming part of the apparatus significantly contributes to a disturbance-free operation. This component, however, is not always an indispensable part; in some instances it may be omitted since its function may be satisfactorily taken over by the spreader finger.

The above-described processing of the boxes is effected continuously and automatically. The apparatus according to the invention comprises simple means, such as cranks and a differential gear which represent a significant simplification when compared with the known, step-wise operating machines. The result is a lightweight, simple apparatus which operates with a high output capacity, constituting an additional significant advantage.

It will be understood that the above description of the present invention is susceptible to various modifications, changes and adaptations, and the same are intended to be comprehended within the meaning and range of equivalents of the appended claims.

What is claimed is:

1. In an apparatus for closing an open end of a folded cardboard box which has oppositely disposed wide flaps and oppositely disposed narrow flaps connected to the box by crease lines at the open end; the cardboard box further having a glued-in lining projecting outwardly of the box beyond the crease lines; the apparatus having conveyor means on which the boxes are advanced serially and spaced from one another; a wide flap opener for outwardly bending the wide flaps; the improvement comprising a. a lining spreader disposed downstream of said wide flap opener and including a spreader finger;

b. first drive means connected to said spreader finger for rotating said spreader finger and cyclically introducing it into the opening of the serially advanced cardboard boxes for spreading and partially flattening a leading end of said lining;

c. a pressure shuttle carrying two pressure rails for movement downstream of said lining spreader; said pressure rails bilaterally cooperating with the lining precedingly handled by said lining spreader for completing the flattening of the lining;

d. second drive means for imparting a reciprocating motion to said pressure shuttle for effecting a reciprocating motion of said pressure rails;

e. means for coordinating the motions of said spreader finger with said pressure shuttle;

f. means for synchronizing the motion of said conveyor means with the motions of said spreader finger and said pressure shuttle;

g. an arm having one end rotatably coupled to said first drive means and another, forked end; said spreader finger being pivotally attached to said arm; and h. a spring urging said arm against a tine of said forked end.

2. In an apparatus for closing an open end of a folded cardboard box which has oppositely disposed wide flaps and oppositely disposed narrow flaps connected to the box by crease lines at the open end; the cardboard box further having a glued-in lining projecting outwardly of the box beyond the crease lines; the apparatus having conveyor means on which the boxes are advanced serially and spaced from one another; a wide flap opener for outwardly bending the wide flaps; the improvement comprising a. a lining spreader disposed downstream of said wide flap opener and including a spreader finger;

b. a support shaft on which said spreader finger is rotatably mounted;

c. first drive means connected to said spreader finger for rotating said spreader finger and cyclically introducing it into the opening of the serially advanced cardboard boxes for spreading and partially flattening a leading end of said lining; said first drive means including means for rotating said spreader finger about said shaft at a non-uniform velocity and for rotating said spreader finger, at least during one part of its introduction into the cardboard box opening with a circumferential speed that is higher than the conveying speed of the boxes;

d. a pressure shuttle carrying two pressure rails for movement downstream of said lining spreader; said pressure rails bilaterally cooperating with the lining precedingly handled by said lining spreader for completing the flattening of the lining;

e. second drive means for imparting a reciprocating motion to said pressure shuttle for effecting a reciprocating motion of said pressure rails;

f. means for coordinating the motions of said spreader finger with said pressure shuttle; and g. means for synchronizing the motion of said conveyor means with the motions of said spreader finger and said pressure shuttle.

3. An apparatus as defined in claim 2, wherein said first drive means includes a differential gear.

4. An apparatus as defined in claim 3, wherein said differential gear includes a. a bevel drive gear mounted on said support shaft and rotatable with respect thereto;

b. means for driving said bevel drive gear with uniform velocity;

c. a driven bevel gear mounted on said support shaft and rotatable with respect thereto; said driven bevel gear being rotationally fixedly secured to said spreader finger;

d. a pinion gear situated between and meshing with said bevel gears; and e. a pivotal arm extending perpendicularly to said shaft and having one end on which said pinion gear is rotatably mounted; and being pivotably supported at a location spaced from said pinion gear.

5. An apparatus as defined in claim 4, wherein said first drive means further comprises a. a drive shaft;

b. a first sprocket wheel fixedly secured to said drive shaft;

c. a second sprocket wheel rotatably secured to said support shaft and rotationally fixedly secured to said bevel drive gear;

d. a chain trained about said sprocket wheels; said drive shaft, said first and second sprocket wheels and said chain forming said means for driving said bevel drive gear with uniform velocity;

e. a crank rotationally fixedly secured to said drive shaft; and f. a pull rod articulated to said crank and to said pivotal arm at said location for imparting to said pivotal arm a cyclical pivotal motion about said support shaft.

6. In an apparatus for closing an open end of a folded cardboard box which has oppositely disposed wide flaps and oppositely disposed narrow flaps connected to the box by crease lines at the open end; the cardboard box further having a glued-in lining projecting outwardly of the box beyond the crease lines; the apparatus having conveyor means on which the boxes are advanced serially and spaced from one another; a wide flap opener for outwardly bending the wide flaps; the improvement comprising a. a lining spreader disposed downstream of said wide flap opener and including a spreader finger;

b. first drive means connected to said spreader finger for rotating said speaker finger and cyclically introducing it into the opening of the serially advanced cardboard boxes for spreading and partially flattening a leading end of said lining;

c. a pressure shuttle carrying two pressure rails for movement downstream of said lining spreader; said pressure rails bilaterally cooperating with the lining precedingly handled by said lining spreader for completing the flattening of the lining;

d. second drive means for imparting a reciprocating motion to said pressure shuttle for effecting a reciprocating motion of said pressure rails;

e. means for coordinating the motions of said spreader finger with said pressure shuttle;

f. means for synchronizing the motion of said conveyor means with the motions of said spreader finger and said pressure shuttle;

g. a narrow flap lifter having a folding pin positioned between said spreader finger and said pressure rails; and h. means for imparting an endless traveling motion to said folding pin for engaging the narrow flaps and lifting them beyond the highest position of said pressure rails.

7. A apparatus as defined in claim 6, wherein said means for imparting an endless travelling motion to said folding pin includes an endless chain carrying said folding pin and trained about spaced sprocket wheels and means for driving said chain.

8. An apparatus as defined in claim 6, said first drive means including means for rotating said spreader finger at a non-uniform speed; further comprising means for driving said folding pin such that its speed of travel is higher than the maximum circumferential speed of said spread finger.

9. In an apparatus for closing an open end of a folded cardboard box which has oppositely disposed wide flaps and oppositely disposed narrow flaps connected to the box by crease lines at the open end; the cardboard box further having a glued-in lining projecting outwardly of the box beyond the crease lines; the apparatus having conveyor means on which the boxes are advanced serially and spaced from one another; a wide flap opener for outwardly bending the wide flaps; the improvement comprising a. a lining spreader disposed downstream of said wide flap opener and including a spreader finger;

b. support means for carrying said spreader finger and limiting the motion of said spreader finger solely to a rotary motion about an axis of rotation passing through said spreader finger;

c. first drive means connected to said spreader finger for rotating said spreader finger and cyclically introducing it into the opening of the serially advanced cardboard boxes for spreading and partially flattening a leading end of said lining;

d. a pressure shuttle carrying two pressure rails for movement downstream of said lining spreader; said pressure rails bilaterally cooperating with the lining precedingly handled by said lining spreader for completing the flattening of the lining;

e. second drive means for imparting a reciprocating motion to said pressure shuttle for effecting a reciprocating motion of said pressure rails;

f. means for coordinating the motions of said spreader finger with said pressure shuttle; and g. means for synchronizing the motion of said conveyor means with the motions of said spreader finger and said pressure shuttle.

10. An apparatus as defined in claim 1, further comprising guide rods on which said pressure shuttle is slidably mounted; said second drive means including a crank drive and a pull rod connected to said crank drive and said pressure shuttle.

* * * * *